US010208569B2

(12) United States Patent
Steele

(10) Patent No.: US 10,208,569 B2
(45) Date of Patent: Feb. 19, 2019

(54) MAINBORE CLEAN OUT TOOL

(71) Applicant: Halliburton Energy Services, Inc., Houston, TX (US)

(72) Inventor: David Joe Steele, Arlington, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 418 days.

(21) Appl. No.: 14/898,730

(22) PCT Filed: Jul. 31, 2013

(86) PCT No.: PCT/US2013/053030
§ 371 (c)(1),
(2) Date: Dec. 15, 2015

(87) PCT Pub. No.: WO2015/016912
PCT Pub. Date: Feb. 5, 2015

(65) Prior Publication Data
US 2016/0130914 A1 May 12, 2016

(51) Int. Cl.

| | |
|---|---|
| ***E21B 27/00*** | (2006.01) |
| ***E21B 37/00*** | (2006.01) |
| ***E21B 12/06*** | (2006.01) |
| ***E21B 17/18*** | (2006.01) |
| ***E21B 34/08*** | (2006.01) |

(Continued)

(52) U.S. Cl.
CPC ..... *E21B 37/00* (2013.01); *E21B 12/06* (2013.01); *E21B 17/18* (2013.01); *E21B 27/00* (2013.01); *E21B 34/08* (2013.01); *E21B 43/38* (2013.01); *E21B 2034/007* (2013.01)

(58) Field of Classification Search
CPC .. E21B 41/0035; E21B 41/0042; E21B 27/00; E21B 27/05; E21B 23/002; E21B 7/061
See application file for complete search history.

(56) References Cited

U.S. PATENT DOCUMENTS 2,290,141 A * 7/1942 Burt ..... E21B 33/124 166/100
2,556,849 A 6/1951 Nolley et al.
(Continued)

FOREIGN PATENT DOCUMENTS

| | | |
|---|---|---|
| CN | 102007264 | 4/2011 |
| RU | 2147665 | 4/2000 |

(Continued)

OTHER PUBLICATIONS

International Search Report and Written Opinion of PCT Application No. PCT/US2013/053030 dated Apr. 22, 2014: pp. 1-14.
(Continued)

*Primary Examiner* — Shane Bomar
(74) *Attorney, Agent, or Firm* — Chamberlain Hrdlicka

(57) ABSTRACT

An assembly configured to be disposed within a well at an intersection of a parent bore of the well and a lateral bore of the well is provided. The assembly includes a junction having a mainbore leg and a lateral leg, as well as a passage in the mainbore leg configured to receive a flowing fluid. A port in the mainbore leg is in fluid communication with the passage such that the flowing fluid in the passage creates a suction at the port to draw debris in the well through the port and into the passage.

17 Claims, 8 Drawing Sheets

(51) Int. Cl.
*E21B 43/38* (2006.01)
*E21B 34/00* (2006.01)

(56) References Cited

U.S. PATENT DOCUMENTS

| | | | | |
|---|---|---|---|---|
| 2,674,318 | A * | 4/1954 | Sutliff | E21B 27/00 137/844 |
| 2,874,781 | A * | 2/1959 | McGaffey | E21B 27/00 166/167 |
| 3,023,810 | A | 3/1962 | Anderson | |
| 3,120,872 | A | 2/1964 | Anderson | |
| 3,198,256 | A * | 8/1965 | Kirby, II | E21B 27/005 166/99 |
| 4,744,420 | A | 5/1988 | Patterson et al. | |
| 5,269,384 | A * | 12/1993 | Cherrington | E21B 7/28 175/102 |
| 5,477,925 | A | 12/1995 | Trahan et al. | |
| 6,158,512 | A | 12/2000 | Unsgaard | |
| 6,276,452 | B1 | 8/2001 | Davis et al. | |
| 7,048,056 | B1 | 5/2006 | Blake | |
| 7,753,113 | B1 * | 7/2010 | Penisson | E21B 27/00 166/162 |
| 7,775,299 | B2 | 8/2010 | Khan et al. | |
| 7,909,094 | B2 | 3/2011 | Schultz et al. | |
| 8,061,426 | B2 | 11/2011 | Surjaatmadja | |
| 8,132,625 | B2 | 3/2012 | Anderson | |
| 8,225,859 | B1 | 7/2012 | Moidel et al. | |
| 8,257,585 | B2 | 9/2012 | Davis et al. | |
| 8,376,066 | B2 | 2/2013 | Steele et al. | |
| 2002/0112857 | A1 | 8/2002 | Ohmer et al. | |
| 2003/0127227 | A1 | 7/2003 | Fehr et al. | |
| 2004/0159435 | A1 * | 8/2004 | Plucheck | E21B 41/0042 166/313 |
| 2005/0072576 | A1 * | 4/2005 | Henriksen | E21B 34/08 166/386 |
| 2005/0115713 | A1 | 6/2005 | Restarick et al. | |
| 2007/0131426 | A1 * | 6/2007 | Telfer | E21B 27/00 166/301 |
| 2008/0277166 | A1 * | 11/2008 | Orban | E21B 4/18 175/76 |
| 2009/0071644 | A1 * | 3/2009 | Themig | E21B 33/12 166/188 |
| 2010/0288492 | A1 | 11/2010 | Blackman et al. | |
| 2011/0011580 | A1 * | 1/2011 | Clark | E21B 33/124 166/244.1 |
| 2011/0036576 | A1 * | 2/2011 | Schultz | E21B 36/02 166/303 |
| 2012/0061073 | A1 | 3/2012 | Soni et al. | |
| 2012/0118571 | A1 * | 5/2012 | Zhou | E21B 27/00 166/301 |
| 2012/0152522 | A1 | 6/2012 | Lynde | |
| 2012/0273278 | A1 * | 11/2012 | Zhu | E21B 27/00 175/206 |
| 2012/0305265 | A1 | 12/2012 | Garcia et al. | |
| 2013/0327572 | A1 * | 12/2013 | Sponchia | E21B 41/0035 175/61 |
| 2014/0014343 | A1 * | 1/2014 | Saurer | E21B 27/00 166/298 |
| 2015/0027714 | A1 * | 1/2015 | Parlin | E21B 33/12 166/312 |
| 2016/0341010 | A1 * | 11/2016 | Hepburn | E21B 23/002 |
| 2017/0107794 | A1 * | 4/2017 | Steele | E21B 17/003 |

FOREIGN PATENT DOCUMENTS

| | | |
|---|---|---|
| RU | 2436925 | 12/2011 |
| RU | 2471065 | 12/2012 |
| SU | 01798466 | 2/1993 |

OTHER PUBLICATIONS

Anonymous, "Vac Tech Downhole Eductor System Reverse Circulating Debris Extraction System," Document #H07769, Apr. 2012: p. 1.

Anonymous, "CleanWell System Technology," Document #H09669, Aug. 2012: p. 1.

Anonymous, "Vac Tech Downhole Eductor System," Halliburton Quicksheet, retrieved Dec. 2, 2015: p. 1, <http://www.halliburton.com/en-US/ps/completions/well-completions/wellbore-cleaning-technology/debris-extraction-tools/vac-tech-downhole-eductor-system.page>.

Anonymous, "Vectored Annular Cleaning System (VACS) Technology," Baker Hughes Product Sheet, retrieved Dec. 2, 2015: p. 1, <http://www.bakerhughes.com/products-and-services/completions/wellbore-intervention/fishing-services/wellbore-clean-up/vectored-annular-cleaning-system-vacs-technology>.

* cited by examiner

MAINBORE CLEAN OUT TOOL

BACKGROUND

1. Field of the Invention

The present disclosure relates generally to the completion of a well for recovery of subterranean deposits and more specifically to methods and systems for controlling or collecting debris from the well prior to and during completion of the well.

2. Description of Related Art

Wells are drilled at various depths to access and produce oil, gas, minerals, and other naturally-occurring deposits from subterranean geological formations. Hydrocarbons may be produced through a wellbore traversing the subterranean formations. The wellbore may be relatively complex and include, for example, one or more lateral branches. Because branches within the wellbore may intersect other branches, the formation of these branches may result in an accumulation of debris at the intersection of the branches. Debris removal is important to ensure the proper installation of completion assemblies in the well preceding production. Debris that is not removed may serve as an impediment to proper sealing, especially in a high pressure environment such as those where wellbore pressures may be 5,000 psi or higher.

While existing systems may contemplate removing debris from a well, it also is important to minimize the number of trips into the well during the completion stages. Fewer trips made to remove debris and install completion equipment results in reduced completion and production costs.

DETAILED DESCRIPTION OF ILLUSTRATIVE EMBODIMENTS

Figure 1:
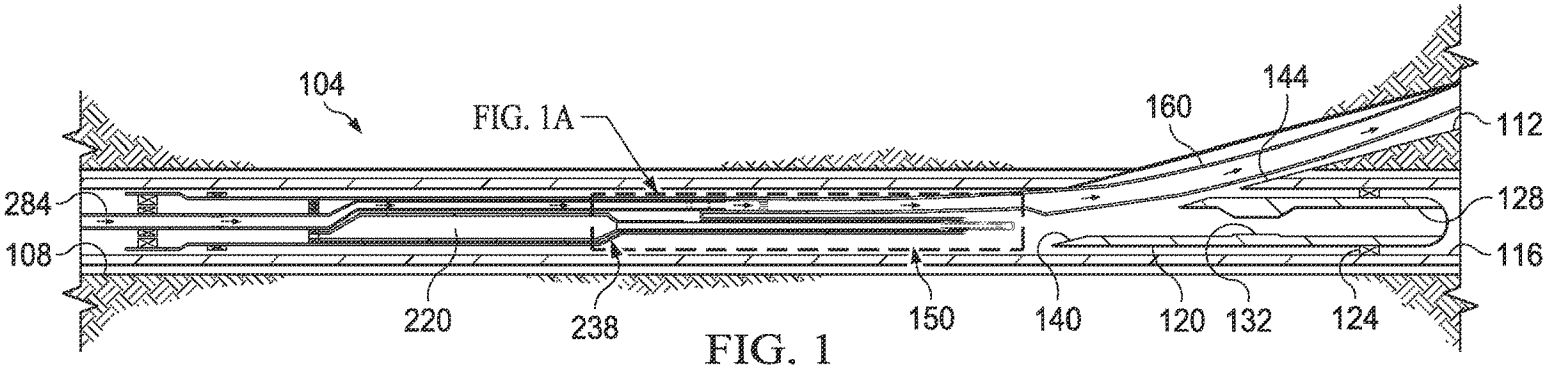
FIG. 1 illustrates a cross-sectional side view of a well having an assembly for completing a well at an intersection of a parent wellbore and a branch wellbore according to an illustrative embodiment, the assembly having a junction being run into the wellbore on a running tool.
Figure 1A:
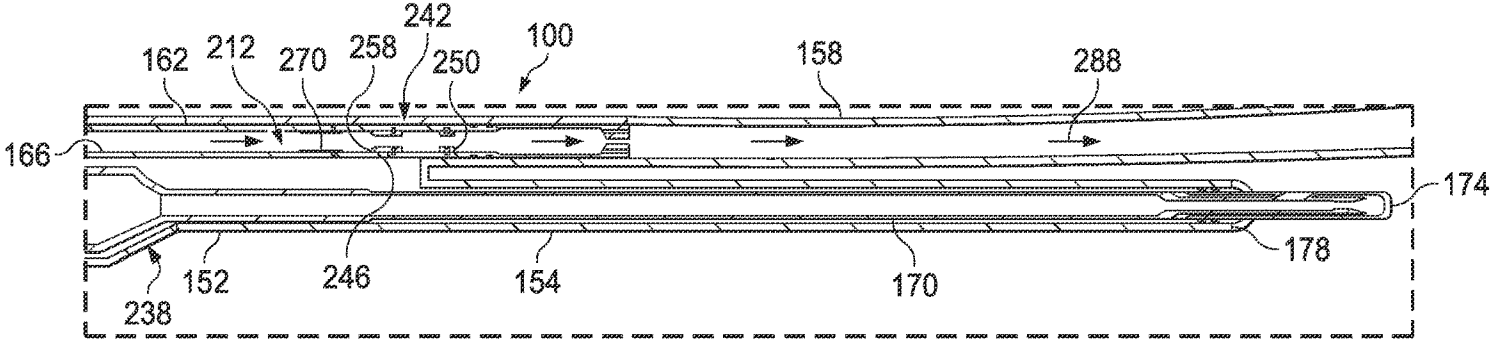

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

The embodiments described herein relate to systems and methods capable of being disposed or performed in a wellbore, such as a parent wellbore, of a subterranean formation and within which a branch wellbore can be formed and completed. A "parent wellbore" or "parent bore" refers to a wellbore from which another wellbore is drilled. It is also referred to as a "main wellbore." A parent or main wellbore does not necessarily extend directly from the earth's surface. For example, it can be a branch wellbore of another parent wellbore. A "branch wellbore," "branch bore," "lateral wellbore," or "lateral bore" refers to a wellbore drilled outwardly from its intersection with a parent wellbore. Examples of branch wellbores include a lateral wellbore and a sidetrack wellbore. A branch wellbore can have another branch wellbore drilled outwardly from it such that the first branch wellbore is a parent wellbore to the second branch wellbore.

While a parent wellbore may in some instances be formed in a substantially vertical orientation relative to a surface of the well, and while the branch wellbore may in some instances be formed in a substantially horizontal orientation relative to the surface of the well, reference herein to either the parent wellbore or the branch wellbore is not meant to imply any particular orientation, and the orientation of each of these wellbores may include portions that are vertical, non-vertical, horizontal or non-horizontal.

The systems and methods described herein may be used to complete a well having a parent bore and at least one branch bore. Because branch bore formation typically involves milling a window in the casing of the parent bore and then subsequently drilling the branch bore, a whipstock may be set in the parent bore proximate the desired intersection of the parent bore and branch bore. The whipstock may include a removable whipface to guide milling tools and drilling assemblies such that the branch bore is initiated at the proper location and angle relative to the parent bore. After milling and drilling of the branch wellbore is completed, a completion deflector may be positioned downhole to divert tools and conduits into the branch wellbore. While traditionally the whipstock and completion deflector have been delivered downhole in separate trips into the wellbore, the process may be combined to minimize trips into and out of the wellbore. Since the completion deflector is positioned near the intersection of the parent and branch bores, debris from the branch bore may collect in the parent bore near the completion deflector and on a deflection surface of the completion deflector. Subsequent completion efforts, namely landing a junction or other furcated assembly at the intersection of the two bores, may be complicated by the inability to obtain an adequate seal when landing the junction in the completion deflector due to the presence of accumulated debris. The system and methods of the embodiments described herein allow removal of the debris from the completion deflector and surrounding area of the well prior to and during the landing of the junction.

Assemblies according to the embodiments described herein may limit the number of trips required to complete a branch wellbore. Limiting the number of trips required to complete the branch wellbore allow rig operators to realize significant cost savings in operation costs. Elimination of trips is provided by the systems and methods described herein by combining the debris clearing function with that of physically landing the junction.

As used herein, the phrases "fluidly coupled," "fluidly connected," and "in fluid communication" refer to a form of coupling, connection, or communication related to fluids, and the corresponding flows or pressures associated with these fluids. Reference to a fluid coupling, connection, or communication between two components describes components that are associated in such a way that a fluid can flow between or among the components.

Referring to FIG. 1, an assembly 100 according to an illustrative embodiment is capable of being run into a well 104 having a parent wellbore 108 and a branch wellbore 112 extending through various earth strata. The parent wellbore 108 may casing 116 that extends from a surface of the well 104 and is cemented in place. The assembly 100 may include a completion deflector 120 that is set within the casing 116 using a latch assembly 124. Latch assembly 124 assists in securing the completion deflector 120 in the casing 116. Although not illustrated in FIG. 1, an additional seal assembly may be positioned in the casing 116 downhole of the latch assembly 124 to sealingly receive the completion deflector 120. The completion deflector 120 includes a central passage 128 extending the length of the completion deflector 120. The central passage 128 includes a landing region 132 in which a cross-sectional area of the central passage 128 is reduced relative to a cross-sectional area of the central passage 128 outside of the landing region 132. The landing region 132 of the central passage 128 is configured to receive a portion of a junction (described in more detail below) and the landing region 132 may include elastomeric seals or other components to provide sealing engagement between the junction and the completion deflector 120.

The completion deflector 120 further includes a deflection surface 140 at an end of the completion deflector 120. Upon setting the completion deflector 120 in the parent wellbore 108, the end of the completion deflector 120 with the deflection surface 140 is positioned in an uphole orientation, and the angled deflection surface 140 is oriented such that the deflection surface 140 is capable of deflecting and guiding select tools and assemblies toward the branch wellbore 112. For example, the deflection surface 140 may deflect a liner or a portion of a junction into the branch wellbore 112.

The assembly 100 may also include a junction 150, or other furcated assembly, having a junction body 152, a seal stinger or mainbore leg 154, and a lateral leg 158. Together the various components of the junction 150 provide a branched conduit that is capable of collecting fluid from the parent wellbore 108 and the branch wellbore 112 when the junction 150 is almost landed at the intersection of the parent wellbore 108 and the branch wellbore 112. While the junction 150 is illustrated with two legs, in some embodiments the junction may include more than two legs for use with certain multilateral wellbores. Fluid from the parent wellbore 108 and branch wellbore 112 may be aggregated in the junction body 152 and delivered to the surface of the well 104 by production tubing (not shown) connected to the junction 150 following landing. The lateral leg 158 may include a lateral string 160 that is configured to filter sediment, debris, or other materials as fluid passes from the branch wellbore 112 to the lateral leg 158 of the junction 150. In some embodiments, the lateral string 160 may include a single or multiple pipes, tubes, or other assemblies. The lateral string 160 may be a slotted liner or include exterior swell packers, inflow control valves, sliding sleeves, or other devices. A screen may be provided in place of the lateral string 160 or may be coupled to or integrated into the lateral string 160. The use of the term "lateral string" herein is not meant to imply that pipes, tubes, or other components forming a part of the lateral string 160 are made of any particular material; rather, the components of the lateral string may be formed from any suitable material, including metallic or non-metallic materials.

Figure 2:
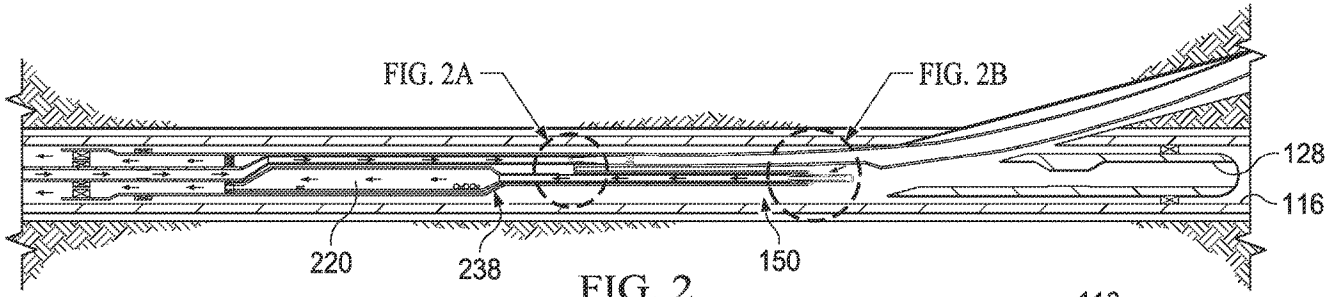
FIG. 2 illustrates a cross-sectional side view of the well and assembly of FIG. 1, the junction having a valve system that has been configured to divert fluid flow within the junction such that a suction is created near a portion of the junction to remove debris form the well.
Figure 2B:
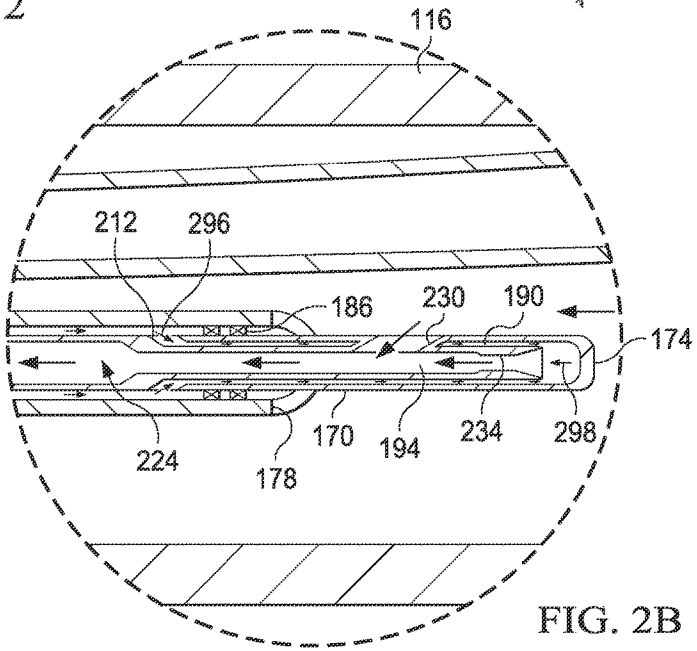
Figure 2A:
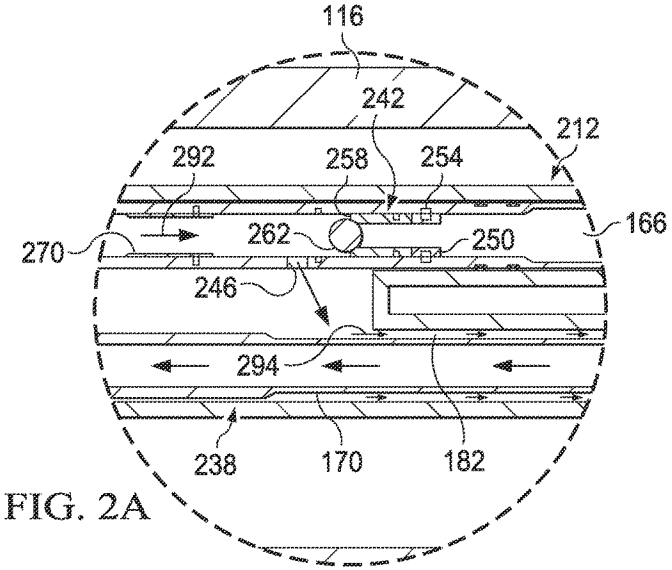

Referring still to FIG. 1 but also to FIG. 2, each of the junction body 152, the mainbore leg 154, and the lateral leg 158 include a passage capable of carrying a fluid. In the embodiment illustrated in FIG. 1, the junction 150 includes one or more liners that provide fluid control within and through the junction 150. For example, the junction includes a lateral liner 162 that may be partially disposed within the lateral leg 158 and partially disposed within the junction body 152. The lateral liner 162 includes a passage 166 that may extend the length of the lateral liner 162 to provide fluid communication through the lateral leg 158 of the junction 150. It will be understood that while the passage 166 is described as being a part of or defined by the lateral liner 162, the passage 166 may also be considered a part of the lateral leg 158 of the junction 150.

A stinger liner 170 may be partially positioned within the mainbore leg 154 and partially positioned within the junction body 152. The stinger liner 170 is elongated and in some embodiments includes a closed end 174 that extends from an opening 178 in the mainbore leg 154. The stinger liner 170 includes an outer diameter that is less than an inner diameter of the mainbore leg 154, and therefore the stinger liner 170 may be positioned along a length of the mainbore leg 154 such that an annulus 182 is created between mainbore leg 154 and the stinger liner 170. Sealing members 186 secure the stinger liner 170 within the mainbore leg 154 and prevent fluid in the annulus 182 from exiting the opening 178. An outer conduit 190 and an inner conduit 194 are provided within the stinger liner 170, the outer conduit 190 extending from a port 212 in the stinger liner 170 to the closed end 174 of the stinger liner 170. The port 212 is configured to allow fluid communication between the annulus 182 and the outer conduit 190. The inner conduit 194 fluidly communicates with the outer conduit 190 and extends from the closed end 174 of the stinger liner 170 to a debris chamber 220, which may be a part of the stinger liner 170, may be a part of a separate liner, or may be an independent chamber more-permanently positioned within the junction 150. Together, the annulus 182, the outer conduit 190, and the inner conduit 194 form a passage 224 that is associated with both the stinger liner 170 and the junction 150. It will be understood that while the passage 224 may be described as being a part of or at least partially defined by the stinger liner 170, the passage 224 may also be considered a part of the mainbore leg 154 of the junction 150.

The stinger liner 170 further includes a port or collection port 230 positioned proximate the closed end 174 of the stinger liner 170. The port 230 allows fluid communication between the inner conduit 194 and an area outside of the stinger liner 170 or mainbore leg 154. The port 230 may pass through a wall of the stinger liner 170 at an angle oriented toward an intended direction of fluid flow within the inner conduit 194. The port 230 is not directly fluidly coupled to the outer conduit 190. In other words, fluid flowing through the outer conduit 190 does not enter the port 230 but rather travels to the closed end 174 of the stinger liner 170 and reverses direction as it flows into the inner conduit 194. After entering the inner conduit 194, but prior to reaching the port 230, fluid may pass through a reduced diameter region 234 of the inner conduit 194, which results in an increase in the velocity of fluid flow. As the fluid flows past the port 230, a suction is created at the port 230 due to a Venturi effect described by Bernoulli's principle and the equation of continuity. The suction created at the port 230 is capable of drawing fluid and debris from an area proximate the port 230 into the inner conduit 194. Again, it is important to recognize that, similar to the passage 224, the port 230, as a part of the stinger liner 170, may also be considered a part of the mainbore leg 154 of the junction 150.

In some embodiments, the stinger liner 170 may be omitted from the mainbore leg 154, and instead the passage 224 may be routed directly through the mainbore leg 154 and the port 230 may be positioned directly in a wall of the mainbore leg 154 such that fluid flow through the passage 224 and past the port 230 creates a suction at the port 230 capable of drawing fluid and debris into the passage 224 through the port 230. For example, the collection port could in these embodiments be opening 178 of the mainbore leg 154.

In the embodiments illustrated in FIGS. 1 and 2, the lateral liner 162, the stinger liner 170 and the debris chamber 220 cooperate to form a mainbore cleanout tool 238. The mainbore cleanout tool 238 is capable of routing fluid flow to create a suction at a collection port so that debris may be collected from the wellbore. While in the specific embodiments illustrated in FIGS. 1 and 2, the mainbore cleanout tool 238 is removable from the remainder of the junction 150, the mainbore cleanout tool 238 could instead be a more permanent part of the junction 150. While primarily described herein as being a part of a junction or furcated assembly, the mainbore cleanout tool 238 could instead be associated with other downhole assemblies. For example, instead of being associated with a junction, the mainbore cleanout tool may simply associated with or coupled to a seal assembly such as the stinger liner 170 (or a seal stinger) that may be used to create a seal downhole between the seal assembly and a polished bore receptacle (PBR). In such an embodiment, the seal assembly may be used in a single wellbore without need for a junction.

Referring still to FIGS. 1 and 2, a valve assembly 242 is positioned within or fluidly coupled to the passage 166 of the lateral leg 158 such that the valve assembly 242 is capable of selectively allowing fluid flow through the entire length of the passage 166 or is capable of diverting fluid flow through a diverter port 246 in the lateral liner 162 to allow fluid communication with the passage 224 of the mainbore leg 154.

While the valve assembly 242 may be a selectable-position valve, the valve assembly 242 in some embodiments may include one or more deployable balls and one or more slidable sleeves and valve seats. More specifically, the embodiment illustrated in FIGS. 1 and 2, a valve seat 250 is positioned in the passage 166 on a downhole side of the diverter port 246. The valve seat 250 is anchored by shear pins 254 having a predicted shear strength. A first slidable sleeve 258 is configured to cover the diverter port 246 when the first slidable sleeve 258 is positioned in a first position as illustrated in FIG. 1. A first ball 262 is deployable into the passage 166 to engage the first slidable sleeve 258 and move the first slidable sleeve 258 into a second position as illustrated in FIG. 2. In the second position, the first slidable sleeve 258 contacts the valve seat 250 and at least partially uncovers the diverter port 246 to allow fluid communication between the passage 166 and the passage 224.

Figure 8:
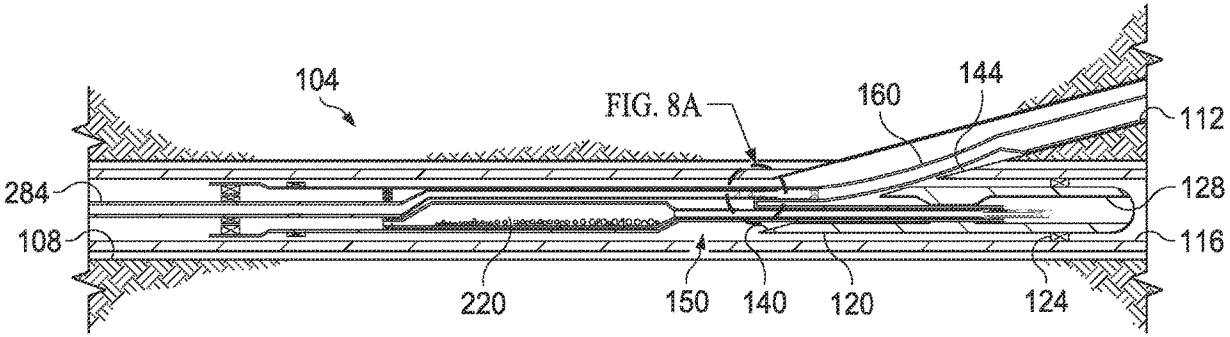
FIG. 8 illustrates a cross-sectional side view of the well and assembly of FIG. 1, the junction having received a deployable ball in a second position to assist in reestablishing flow of fluid into the branch wellbore.
Figure 8A:
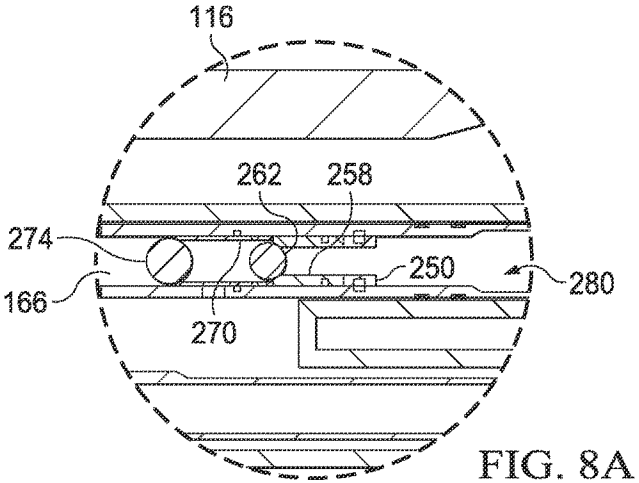
Figure 9:
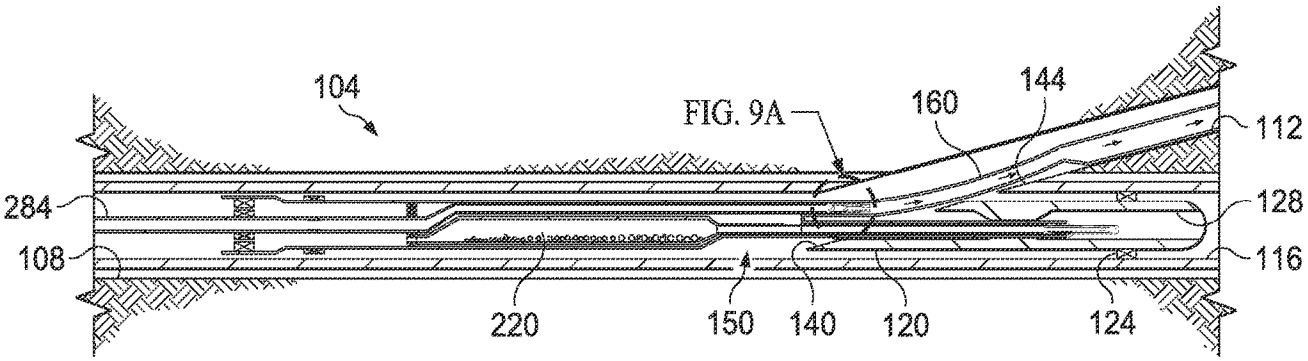
FIG. 9 illustrates a cross-sectional side view of the well and assembly of FIG. 1, the junction having reestablished flow of fluid into the branch wellbore.
Figure 9A:
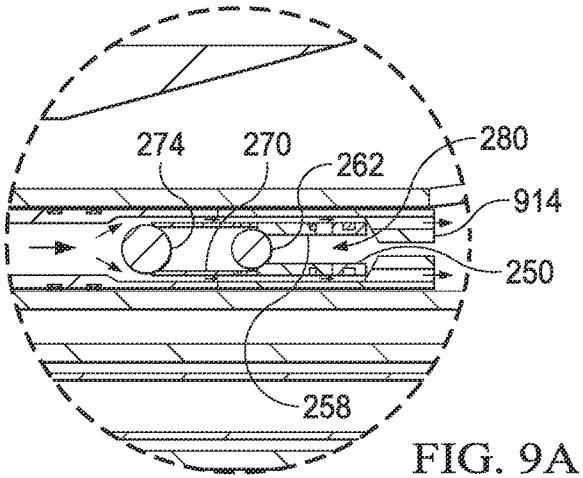

Referring still to FIGS. 1 and 2, but also to FIGS. 8 and 9, a second slidable sleeve 270 is positioned in a first position upstream of the first slidable sleeve 258 as illustrated in FIG. 2. A second ball 274 is deployable into the passage 166 to engage the second slidable sleeve 270 and move the second slidable sleeve 270 into a second position illustrated in FIG. 8. In the second position, the second slidable sleeve 270 contacts the first slidable sleeve 258, and either the second ball 274 or the second slidable sleeve 270 prevents fluid communication through the diverter port 246 when the second slidable sleeve 270 is in the second position. As illustrated in FIG. 9, a catch chamber 280 is fluidly coupled to and disposed downstream of the passage 166. The catch chamber 280 is configured to receive the first slidable sleeve 258, the first ball 262, the second slidable sleeve 270, and the second ball 274 when a force is exerted on the second ball sufficient to shear the shear pins 254 and release the valve seat 250 and first slidable sleeve 258 within the passage 166. When the first slidable sleeve 258, the first ball 262, the second slidable sleeve 270, and the second ball 274 enter the catch chamber 280, the larger cross-sectional area of the catch chamber 280 relative to passage 166 permits fluid communication through the catch chamber 280.

Referring again primarily to FIG. 1, in operation, the junction 150 is tripped into the parent wellbore 108 or casing 116 on a running tool 284. The running tool 284 may be fluidly connected to the lateral liner 162 and is capable of communicating fluid from a surface of the well 104 and through the lateral leg 158 of the junction 150. Other equipment may also be attached downhole of the junction 150. For example, a tubing string, a mud motor and drill bit, or other equipment may be attached to the junction 150 or lateral string 160 to circulate debris out of the path of the lateral string 160 or to remove debris in the event of a partial collapse of the branch wellbore 112. In this scenario, "wash pipe", or small diameter tubing, may be run downhole attached to the mainbore cleanout tool 238 and then pulled out of the wellbore upon removal of the mainbore cleanout tool 238, thereby leaving the junction 150, lateral string 160, and any large diameter tools (i.e. drill bit, mud motor, etc.) downhole.

In FIG. 1, as the lateral leg 158, lateral string 160, or other equipment come into contact with the deflection surface 140, the lateral leg 158, lateral string 160, and equipment are deflected into the branch wellbore 112. As the components advance into the branch wellbore 112, fluid may be delivered through the lateral leg 158, indicated by arrows 288, to remove and flush dirt, blockages, and other debris from the branch wellbore 112.

In FIG. 1, the positioning of the first slidable sleeve 258 in the first position prevents communication of fluid through the diverter port 246. Referring again to FIG. 2, as the mainbore leg 154 of the junction 150 approaches the completion deflector 120, the valve assembly 242 is positioned to divert fluid flow from the passage 166 into the passage 224. While the positioning of the mainbore leg 154 relative to the completion deflector 120 may vary depending on downhole conditions and the specific configuration of the valve assembly 242, in some embodiments, it may be desirable to activate or position the valve assembly 242 when the mainbore leg 154 is within two meters of being landed in the completion deflector 120.

When the first ball 262 is deployed from the surface into the running tool 284, the first ball 262 travels into the passage 166 and engages the first slidable sleeve 258. The first ball 262 lodges against the first slidable sleeve since it is sized such that it cannot pass through the first slidable sleeve 258. By exerting a fluid pressure on the first ball 262, the first ball 262 slides the first slidable sleeve 258 into the second position to contact the valve seat 250, which also uncovers the diverter port 246. The continued fluid pressure on the first ball 262 results in sealing engagement of the ball to the first slidable sleeve 258, thereby preventing or substantially reducing fluid flow past the first ball 262.

With the diverter port 246 uncovered, the fluid delivered through the passage 166 (indicated by arrows 292) enters the annulus 182 (as indicated by arrows 294). As previously described, the fluid enters the outer conduit 190 through the port 212 (as indicated by arrows 296) and proceeds to the closed end 174 of the stinger liner 170. At the closed end 174, the fluid reverses direction and enters the inner conduit 194 as indicated by arrows 298. After entering the inner conduit 194, fluid flows past the port 230, and a suction is created at the port 230 as previously described. This suction provides the ability to clear debris from the well in proximity to the completion deflector as the junction continues to advance and is landed.

Figure 3:
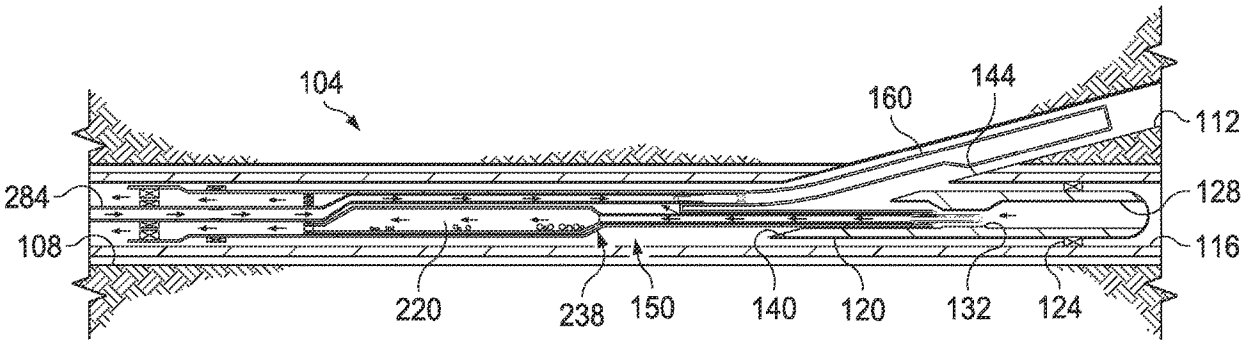
FIG. 3 illustrates a cross-sectional side view of the well and assembly of FIG. 1, the junction having been advanced into a completion deflector such that debris is removed proximate the completion deflector.

Referring now to FIG. 3, with the suction created at port 230 due to the diversion of fluid described above, the mainbore leg 154 is capable of cleaning debris such as rock, soil, and other formation solids from the area around the deflection surface 140 and the landing region 132 of the completion deflector. This suction is continued as the mainbore leg 154 is advanced into the completion deflector as illustrated in FIG. 3. As debris is pulled through the port 230 into the fluid stream traveling through inner conduit 194, the debris and fluid passes into the debris chamber 220, which is fluidly connected to the inner conduit 194 and in some embodiments includes a cross-sectional area (taken normal to fluid flow) greater than that of the inner conduit 194. The increased cross-sectional area allows the velocity of fluid to decrease upon entering the debris chamber 220. This decrease in fluid velocity allows debris entrained within and pushed along by the fluid to settle to the bottom of the debris chamber 220 for collection.

Figure 5:
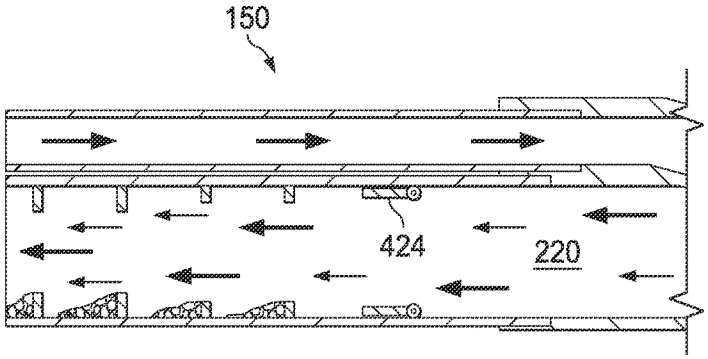
FIG. 5 illustrates the debris chamber of FIG. 4 with the spring-biased door positioned in an open position.
Figure 4:
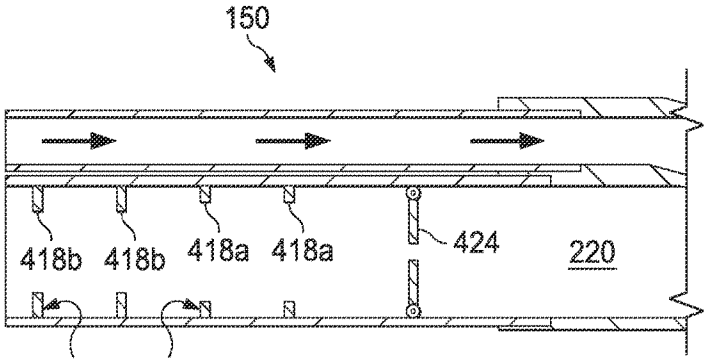
FIG. 4 illustrates a cross-sectional side view of a debris chamber of the junction of FIG. 1, the debris chamber having a spring-biased door in a closed position.

Referring to FIGS. 4 and 5, in some embodiments, the debris chamber 220 may include a plurality of baffles 418 arranged along a wall of the debris chamber 220. In some embodiments, the baffles 418 may simply be rings positioned along an interior surface of the debris chamber 220. In other embodiments, a spiral or helical configuration of baffles may be provided. In the embodiment illustrated in FIGS. 4 and 5, baffles 418*a* are positioned upstream of baffles 418*b* and extend a lesser distance from the wall of the debris chamber 220. This configuration of differently sized baffles may be advantageous since less flow disruption may be desired for fluid entering the debris chamber 220. In other words, since greater quantities (and presumably larger pieces) of debris are present when the fluid and debris first enter the debris camber 220, less turbulence may be required to urge settling of the debris behind the baffles 418*a*. As flow through the debris chamber progresses, however, more turbulence and thus larger baffles 418*b* may be desired in order to collect additional debris.

FIGS. 4 and 5 also illustrate optional spring-loaded doors 424 at or near an inlet of the debris chamber 220. The doors 424 assist in capturing debris and preventing inadvertent loss of the debris following collection or during removal of the debris chamber 220 from the well 104. In FIG. 4, the doors 424 are illustrated in a spring-biased, closed position when no fluid is entering the debris chamber 220. In FIG. 5, as fluid flows into the debris chamber 220, the fluid pushes the doors 424 into an open position.

Figure 6:
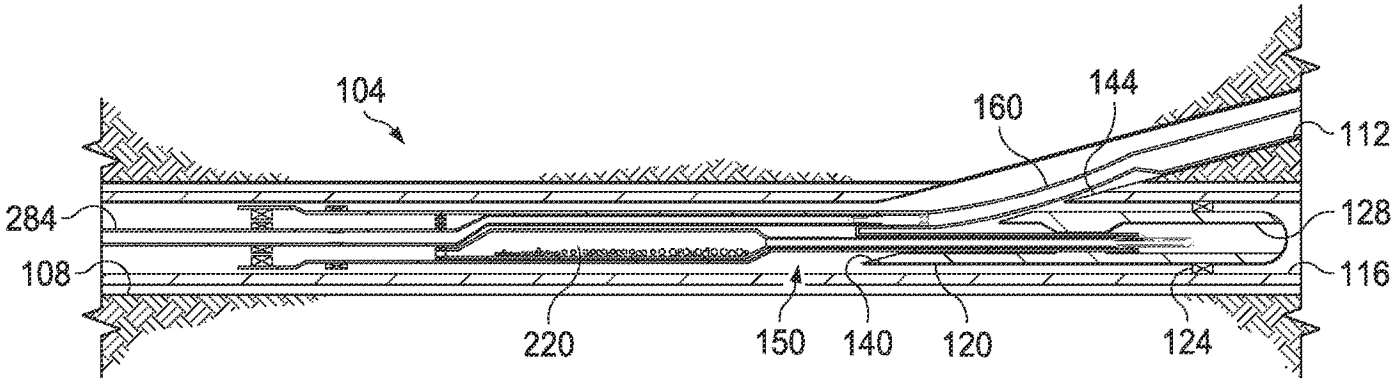
FIG. 6 illustrates a cross-sectional side view of the well and assembly of FIG. 1, the junction having been landed at the completion deflector following collection of the debris.

Referring to FIG. 6, following collection of debris in the debris chamber 220, the mainbore leg 154 of the junction 150 is landed within the completion deflector 120 and flow of fluids to the junction 150 may be temporarily halted.

Figure 7:
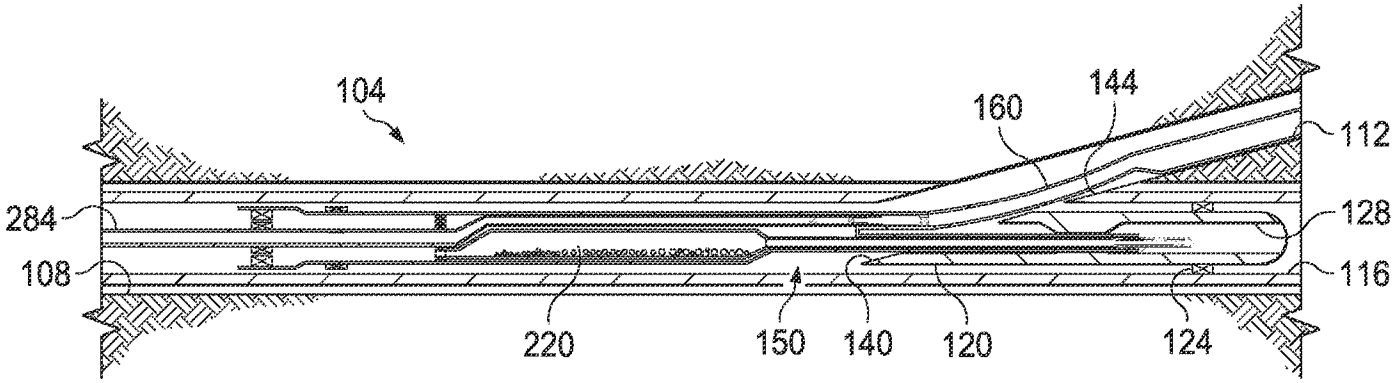
FIG. 7 illustrates a cross-sectional side view of the well and assembly of FIG. 1, the junction having received a deployable ball in a first position to assist in reestablishing flow of fluid into the branch wellbore.

Referring to FIGS. 7 and 8, the second ball 274 may optionally be deployed through the running tool 284 into the passage 166 if it is desired to reestablish circulation of fluid through the lateral leg 158 of the junction 150. It may be desired to reestablish such flow to flush debris or other materials from the branch wellbore 112. If the second ball 274 is indeed deployed, the second ball 274 travels into the passage 166 until contacting the second slidable sleeve 270. By exerting fluid pressure upstream of the second ball 274, a force sufficient to dislodge the second slidable sleeve 270 (by shearing pins associated with the second slidable sleeve 270) from the first position (illustrated in FIG. 7) moves the second ball 274 and the second slidable sleeve 270 to the second position illustrated in FIG. 8. In this second position, the second slidable sleeve 270 contacts the first slidable sleeve 258, and either the second ball 274 or the second slidable sleeve 270 prevents fluid communication through the diverter port 246. At this point in the operation of the assembly 100, fluid communication through both the lateral leg 158 and the mainbore leg 154 is prevented or substantially reduced.

Referring to FIG. 9, additional fluid pressure applied upstream of the second ball 274 exerts a shearing force on the shear pins 254 associated with the valve seat 250. The shearing of the shear pins 254 permits the first slidable sleeve 258, the first ball 262, the second slidable sleeve 270, and the second ball 274 to move through the passage 166 and into the catch chamber 280 that is fluidly coupled to and disposed downstream of the passage 166. A shoulder 914 in the catch chamber 280 prevents exit of the first slidable sleeve 258, the first ball 262, the second slidable sleeve 270, and the second ball 274 from the catch chamber 280. The larger cross-sectional area of the catch chamber 280 relative to passage 166 permits fluid communication around the first slidable sleeve 258, the first ball 262, the second slidable sleeve 270, and the second ball 274 within the catch chamber 280, thereby reestablishing fluid communication with the branch wellbore 112. Reestablishment of fluid communication with the branch wellbore 112 allows setting of the junction and packers as described below.

Figure 10:
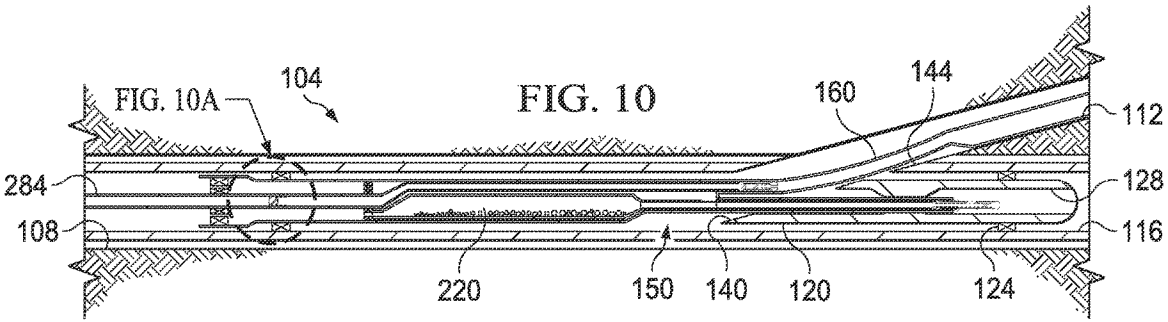
FIG. 10 illustrates a cross-sectional side view of the well and assembly of FIG. 1, the running tool having received a deployable ball to assist in sealing the junction and removing the running tool.
Figure 10A:
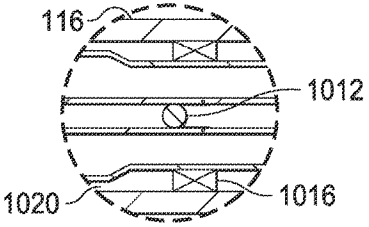
Figure 11:
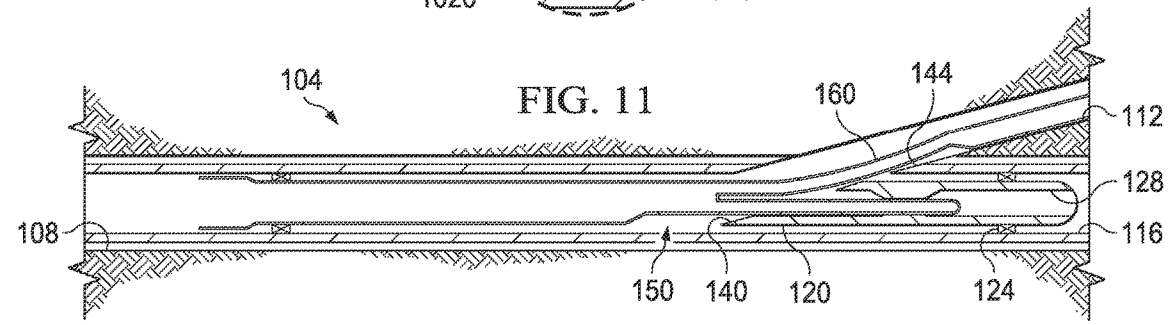
FIG. 11 illustrates a cross-sectional side view of the well and assembly of FIG. 1, the junction having been positioned in the well and the running tool removed from the well.

Referring to FIGS. 10 and 11, the running tool 284, the stinger liner 170, and the lateral liner 162 may be removed from the junction 150. A third ball 1012 is deployable downhole through the running tool 284 to assist in setting sealing member or packer 1016. The packer 1016 is positioned within an annulus 1020 between the junction 150 and the casing 116 to prevent fluid in the annulus 1020 downhole of the packer 1016 from flowing to the surface of the well 104. After the packer 1016 has been set, the running tool 284, the stinger liner 170 (including the debris chamber 220), and the lateral liner 162 are removed from the well 104. Following removal of these components, the landing and installation of the junction 150 is complete, as illustrated in FIG. 11, and the junction 150 is able to aggregate production fluids from both the branch wellbore 112 and the parent wellbore 108 prior to delivery of the production fluids to the surface of the well 104.

Figure 12:
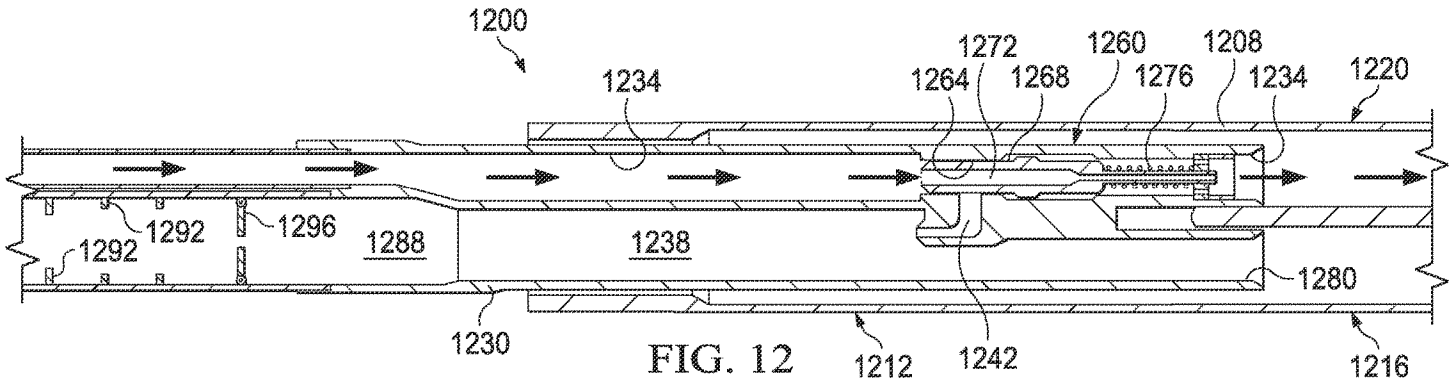
FIG. 12 illustrates a cross-sectional side view of an assembly for completing a well at an intersection of a parent wellbore and a branch wellbore according to an illustrative embodiment, the assembly having a junction and a valve system positioned in a first position.
Figure 13:
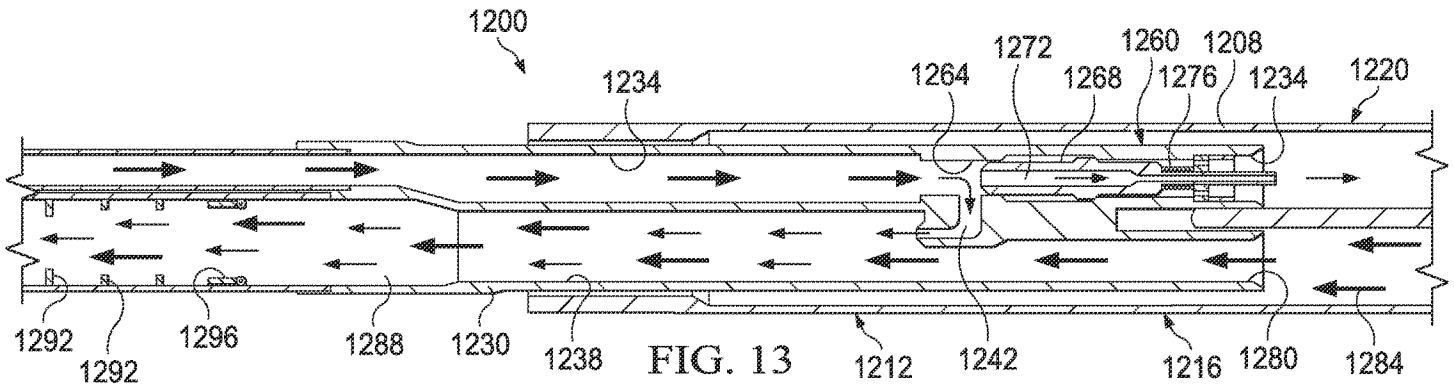
FIG. 13 illustrates a cross-sectional side view of the assembly of FIG. 12, the valve system positioned in a second position.

Referring to FIGS. 12 and 13, an assembly 1200 according to an illustrative embodiment may be positioned in a well similar to the assembly 100 previously described with reference to FIGS. 1-11. The assembly 1200 may include a completion deflector (not shown) similar to completion deflector 120 that is set within a parent wellbore. The assembly 1200 may further include a junction 1208 that includes a junction body 1212, a mainbore leg 1216, and a lateral leg 1220. The junction 1208 is capable of being landed at an intersection of the parent wellbore and a branch wellbore similar to those previously described. The mainbore leg 1216 is received by the completion deflector or another completion device that assists in securing the junction 1208 at the intersection and that provides sealing engagement between the mainbore leg 1216 and the parent wellbore, thereby ensuring that production fluids from the parent wellbore enter the mainbore leg 1216. The lateral leg 1220 is positioned in the branch wellbore and may include a screen as previously described.

Each of the junction body 1212, the mainbore leg 1216, and the lateral leg 1220 include a passage capable of carrying a fluid. In the embodiment illustrated in FIGS. 12 and 13, the junction 1208 includes one or more liners that provide fluid control within and through the junction 1208. For example, the junction 1208 includes a liner 1230 that may be partially disposed within each of the junction body 1212, the mainbore leg 1216, and the lateral leg 1220. The liner 1230 includes a passage 1234 that may extend at least partially through the junction body 1212 and at least partially through the lateral leg 1220. The liner further may include a passage 1238 that may extend at least partially through the junction body 1212 and at least partially through the mainbore leg 1216. A diverter port 1242 is capable of providing fluid communication between the passage 1234 and the passage 1238. It will be understood that while the passages 1234, 1238 may be described as being a part of or at least partially defined by the liner 1230, the passages 1234, 1238 may also be considered a part of the lateral leg 1220 and the mainbore leg 1217, respectively, of the junction 1208.

A valve assembly 1260 is positioned within or fluidly coupled to at least one of the passages 1234, 1238 such that the valve assembly 1260 is capable of selectively allowing fluid flow through the entire length of the passage 1234 or is capable of diverting fluid flow through the diverter port 1242 to allow fluid communication with the passage 1238. The valve assembly 1260 may include a variety of flow control components, but in some embodiments, the valve assembly 1260 includes a valve seat 1264 and valve body 1268. The valve body 1268 includes a passageway 1272 through which fluid may flow when the valve body 1268 is in a first position (shown in FIG. 12). In this first position, the valve body 1268 also obstructs the diverter port 1242 preventing fluid communication between the passages 1234, 1238. As pressure in the passage 1234 is increased, a spring 1276, which biases the valve body 1268 toward the first position, is compressed thereby allowing the valve body 1268 to move to a second position (shown in FIG. 13). In the second position, the passageway 1272 is blocked such that fluid may no longer traverse the entire length of passage 1234. The movement of the valve body 1268 to the second position also reveals the diverter port 1242 thereby allowing fluid communication between passage 1234 and passage 1238.

As fluid in the passage 1234 passes through the diverter port 1242 and into the passage 1238, fluid and debris from the well may be drawn into the passage 1234 through a port 1280 provided in the liner 1230 or the mainbore leg 1216. Debris and fluid, indicated by arrows 1284, then pass into a debris chamber 1288. The debris chamber 1288, similar to those previously described, may optionally include baffles 1292 and a spring-biased door 1296 to assist in trapping debris within the debris chamber 1288.

One difference between assembly 1200 and others described herein is that that valve assembly is activated by increasing pressure or flow of fluids downhole. Since debris drawn into passage 1234 is motivated by a negative pressure created nearer the intersection of the mainbore leg 1216 and the lateral leg 1220 (unlike assembly 100 which was motivated by negative pressure generated near an end of the mainbore leg), higher flow rates of fluid through passages 1234, 1238 are necessary to generate the larger amount of suction needed to entrain and pull debris from the well.

Controlling and collecting debris within a well may be important to ensure proper sealing between surfaces in downhole operations. Similarly, the control of debris may be important during the process of completing the well prior to production. The present disclosure describes assemblies, systems, and methods for controlling and collecting debris. In addition to the embodiments described above, many examples of specific combinations are within the scope of the disclosure, some of which are detailed below.

EXAMPLE 1

An assembly configured to be disposed within a well at an intersection of a parent bore of the well and a lateral bore of the well, the assembly comprising:

- a junction having a mainbore leg and a lateral leg;
- a passage in the mainbore leg configured to receive a flowing fluid;
- a port in the junction in fluid communication with the passage such that the flowing fluid in the passage creates a suction at the port to draw debris in the well through the port and into the passage.

EXAMPLE 2

An assembly configured to be disposed within a well at an intersection of a parent bore of the well and a lateral bore of the well, the assembly comprising:

a junction having a mainbore leg and a lateral leg;
a first passage disposed at least partially in the lateral leg;
a second passage disposed at least partially in the mainbore leg; and
a valve assembly fluidly coupled to the first passage to selectively divert fluid from the first passage to the second passage.

EXAMPLE 3

A method for completing a well having a mainbore and a lateral bore, the method comprising:
positioning a junction having a mainbore leg and a lateral leg in the well, the mainbore leg having a collection port in fluid communication with a passage in the mainbore leg;
flowing fluid through the passage to create a suction at the collection port; and
collecting debris from the well through the collection port.

EXAMPLE 4

A mainbore cleanout tool positionable within a wellbore, the mainbore cleanout tool comprising:
a liner having a passage and a port;
a debris chamber in fluid communication with the passage of the liner to receive debris removed from the wellbore through the port;
wherein at least one of the liner and the debris chamber are removably positionable within a furcated assembly.

EXAMPLE 5

The mainbore cleanout tool of Example 4, wherein a suction is created in proximity to the port to draw debris from the wellbore into the passage.

EXAMPLE 6

The mainbore cleanout tool of Example 5, wherein the suction is created by a Venturi effect caused by fluid flowing in the passage.

EXAMPLE 7

A mainbore cleanout tool positionable within a wellbore, the mainbore cleanout tool comprising:
a liner having a passage and a port;
a debris chamber in fluid communication with the passage of the liner to receive debris removed from the wellbore through the port;
wherein at least one of the liner and the debris chamber are removably coupled to a seal stinger.

It should be apparent from the foregoing that embodiments of an invention having significant advantages have been provided. While the embodiments are shown in only a few forms, the embodiments are not limited but are susceptible to various changes and modifications without departing from the spirit thereof.

I claim:

1. An assembly configured to be disposed within a well at an intersection of a parent bore of the well and a lateral bore of the well, the assembly comprising:
a junction comprising:
a junction body,
a mainbore leg extending from the junction body, and
a lateral leg extending from the junction body;
a passage in the mainbore leg configured to receive a flowing fluid;
a port in the junction in fluid communication with the passage such that the flowing fluid in the passage creates a suction at the port to draw debris in the well through the port and into the passage; and
a completion deflector positioned in the mainbore of the well, the completion deflector having a deflection surface oriented to allow diversion of the lateral leg into the lateral bore; wherein the port is oriented to allow collection of debris from the deflection surface as the mainbore leg is landed in the completion deflector.

2. The assembly of claim 1 further comprising a debris chamber disposed in the junction, the debris chamber being in fluid communication with the passage and configured to receive the debris passing through the port.

3. The assembly of claim 1 further comprising: a debris chamber disposed in the junction, the debris chamber being in fluid communication with the passage and configured to receive the debris passing through the port; wherein the debris chamber is removable from the junction following landing of the junction.

4. The assembly of claim 1 further comprising: a debris chamber in fluid communication with the passage and configured to receive the debris passing through the port; wherein the debris chamber has a cross-sectional area that is larger than a cross-sectional area of the passage.

5. The assembly of claim 1 further comprising a debris chamber in fluid communication with the passage, the debris chamber having a plurality of baffles to assist in collecting debris that passes through the port.

6. The assembly of claim 1 further comprising a debris chamber in fluid communication with the passage, the debris chamber having a spring loaded door positioned proximate an upstream side of the debris chamber, the door movable between an open position and a closed position, wherein:
the door is positioned in the open position when flow is present thereby allowing fluid and debris to enter the debris chamber; and
the door is positioned in the closed position when flow ceases thereby reducing the loss of collected debris from the debris chamber.

7. The assembly of claim 1, wherein the port is positioned in a liner of the junction disposed in the mainbore leg.

8. An assembly configured to be disposed within a well at an intersection of a parent bore of the well and a lateral bore of the well, the assembly comprising:
a junction comprising:
a junction body,
a mainbore leg extending from the junction body, and
a lateral leg extending from the junction body;
a first passage disposed at least partially in the lateral leg;
a second passage disposed at least partially in the mainbore leg;
a valve assembly fluidly coupled to the first passage to selectively divert fluid from the first passage to the second passage;
a collection port in the mainbore leg in fluid communication with the second passage such that fluid flowing in the second passage creates a suction at the collection port to draw debris in the well through the collection port and into the second passage; and
a completion deflector positioned in the mainbore of the well, the completion deflector having a deflection surface oriented to allow diversion of the lateral leg into the lateral bore; wherein the collection port is oriented to allow collection of debris from the deflection surface as the mainbore leg is landed in the completion deflector.

9. The assembly of claim 8, wherein the valve assembly comprises:

a valve seat positioned in the first passage;

a diverter port positioned upstream of the valve seat, the diverter port capable of providing fluid communication between the first passage and the second passage;

a slidable sleeve configured to cover the diverter port when the slidable sleeve is positioned in a first position; and a ball deployable into the first passage to engage the slidable sleeve and move the slidable sleeve into a second position, the slidable sleeve in the second position contacting the valve seat and at least partially uncovering the diverter port to allow diversion of fluid from the first passage to the second passage.

10. The assembly of claim 8, wherein the valve assembly comprises:

a valve seat positioned in the first passage;

a diverter port positioned upstream of the valve seat, the diverter port capable of providing fluid communication between the first passage and the second passage;

a first slidable sleeve configured to cover the diverter port when the slidable sleeve is positioned in a first position;

a first ball deployable into the first passage to engage the first slidable sleeve and move the first slidable sleeve into a second position, the first slidable sleeve in the second position contacting the valve seat and at least partially uncovering the diverter port to allow diversion of fluid from the first passage to the second passage;

a second slidable sleeve positioned in a first position upstream of the first slidable sleeve; and a second ball deployable into the first passage to engage the second slidable sleeve and move the second slidable sleeve into a second position, the second slidable sleeve in the second position contacting the first slidable sleeve, either the second ball or the second slidable sleeve preventing fluid communication through the diverter port when the second slidable sleeve is in the second position.

11. The assembly of claim 8, wherein the valve assembly comprises:

a valve seat positioned in the first passage;

a diverter port positioned upstream of the valve seat, the diverter port capable of providing fluid communication between the first passage and the second passage;

a first slidable sleeve configured to cover the diverter port when the slidable sleeve is positioned in a first position;

a first ball deployable into the first passage to engage the first slidable sleeve and move the first slidable sleeve into a second position, the first slidable sleeve in the second position contacting the valve seat and at least partially uncovering the diverter port to allow diversion of fluid from the first passage to the second passage;

a second slidable sleeve positioned in a first position upstream of the first slidable sleeve;

a second ball deployable into the first passage to engage the second slidable sleeve and move the second slidable sleeve into a second position, the second slidable sleeve in the second position contacting the first slidable sleeve, either the second ball or the second slidable sleeve preventing fluid communication through the diverter port when the second slidable sleeve is in the second position; and a catch chamber fluidly coupled to and disposed downstream of the first passage, the catch chamber configured to receive the first slidable sleeve, the first ball, the second slidable sleeve, and the second ball when a force is exerted on the second ball sufficient to release the first slidable sleeve within the first passage.

12. The assembly of claim 8 further comprising a debris chamber disposed in the junction in fluid communication with the second passage and configured to receive the debris passing through the collection port.

13. The assembly of claim 8 further comprising a debris chamber in fluid communication with the second passage and configured to receive the debris passing through the collection port; wherein the debris chamber has a cross-sectional area that is larger than a cross-sectional area of the second passage.

14. The assembly of claim 8 further comprising a debris chamber in fluid communication with the second passage and configured to receive the debris passing through the collection port; wherein the debris chamber includes a plurality of baffles to assist in collecting debris that passes through the collection port.

15. A method for completing a well having a mainbore and a lateral bore, the method comprising:

positioning a junction in the well, the junction comprising a junction body, a mainbore leg extending from the junction body, and a lateral leg extending from the junction body, the mainbore leg having a collection port in fluid communication with a passage in the mainbore leg;

positioning a completion deflector in the mainbore of the well, the completion deflector having a deflection surface oriented to allow diversion of the lateral leg into the lateral bore;

flowing fluid through the passage to create a suction at the collection port; and collecting debris from the deflection surface of the completion deflector through the collection port.

16. The method of claim 15 further comprising landing the mainbore leg in the completion deflector following the collection of debris from the deflection surface.

17. The method of claim 15, wherein flowing fluid through the passage in the mainbore leg further comprises: diverting fluid flowing through a passage in the lateral leg to the passage in the mainbore leg.

* * * * *